US011932915B2

(12) United States Patent
Yuan et al.

(10) Patent No.: US 11,932,915 B2
(45) Date of Patent: Mar. 19, 2024

(54) METHOD FOR FORMING ALUMINUM ALLOY THIN-WALLED CURVED PART BY ULTRA-LOW TEMPERATURE GRADIENT DRAWING

(71) Applicant: Dalian University of Technology, Dalian (CN)

(72) Inventors: Shijian Yuan, Dalian (CN); Xiaobo Fan, Dalian (CN)

(73) Assignee: Dalian University of Technology, Dalian (CN)

( * ) Notice: Subject to any disclaimer, the term of this patent is extended or adjusted under 35 U.S.C. 154(b) by 204 days.

(21) Appl. No.: 17/179,481

(22) Filed: Feb. 19, 2021

(65) Prior Publication Data

US 2022/0017981 A1 Jan. 20, 2022

(30) Foreign Application Priority Data

Jul. 15, 2020 (CN) ..... 202010679021.6

(51) Int. Cl.

| | |
|---|---|
| ***C21D 1/74*** | (2006.01) |
| ***C21D 8/04*** | (2006.01) |
| ***C22C 21/08*** | (2006.01) |
| ***C22C 21/16*** | (2006.01) |
| ***C22C 21/18*** | (2006.01) |

(52) U.S. Cl.

CPC ..... *C21D 1/74* (2013.01); *C21D 8/0421* (2013.01); *C22C 21/08* (2013.01); *C22C 21/16* (2013.01); *C22C 21/18* (2013.01)

(58) Field of Classification Search

None

See application file for complete search history.

(56) References Cited

FOREIGN PATENT DOCUMENTS

CN 107866491 A * 4/2018
CN 108326159 A * 7/2018 ..... B21D 22/22

OTHER PUBLICATIONS

English language machine translation of CN-108326159-A. Generated Nov. 5, 2022. (Year: 2022).*
English language machine translation of CN-107866491-A. Generated Nov. 5, 2022. (Year: 2022).*

* cited by examiner

*Primary Examiner* — Brian D Walck
(74) *Attorney, Agent, or Firm* — Shih IP Law Group, PLLC

(57) ABSTRACT

The present invention provides a method for forming an aluminum alloy thin-walled curved part by ultra-low temperature gradient drawing. This method includes: placing the aluminum alloy sheet on a die, and closing a blank holder to hold the aluminum alloy sheet in a flange zone; filling a cavity of a die with an ultra-low temperature medium to cool a die cavity zone of the aluminum alloy sheet to a set low temperature, and forming an ultra-low temperature gradient in which the temperature of the die cavity zone is lower than the temperature in the flange zone; applying a set blank holder force to the blank holder, and controlling a punch to move downwards to form a deep-cavity thin-walled curved part; and controlling the punch to move upwards, opening the blank holder, and taking out the formed deep-cavity thin-walled curved part.

5 Claims, 3 Drawing Sheets

METHOD FOR FORMING ALUMINUM ALLOY THIN-WALLED CURVED PART BY ULTRA-LOW TEMPERATURE GRADIENT DRAWING

TECHNICAL FIELD

The present invention relates to the technical field of sheet metal forming, in particular to a method for forming an aluminum alloy thin-walled curved part by ultra-low temperature gradient drawing.

BACKGROUND

The aluminum alloy is widely used as a main structural material in aerospace and aviation due to its high specific strength and good corrosion resistance. It accounts for about 80% of the structural mass of the launch vehicle and more than 60% of the structural mass of some aircraft. In order to meet the high reliability, long life and lightweight requirements of the new generation of launch vehicles, aircrafts and new energy vehicles, it is necessary to replace the traditional multi-piece tailor-welded structure with an overall structure of high-strength aluminum alloy. Based on this, a class of high-strength aluminum alloy deep-cavity thin-walled curved parts are emerging, such as the Al—Li alloy dome of rocket fuel tanks, aircraft engine lips and curved covers of new energy vehicles.

At present, deep drawing is a commonly used manufacturing process for forming deep-cavity thin-walled curved parts. It has been widely used in the aviation, aerospace and automotive industries, but it is mainly used for low-carbon steel, stainless steel and other materials with good room temperature plasticity. Deep drawing is also widely used in forming aluminum alloy thin-walled curved parts with a smaller depth (the ratio of depth to equivalent diameter is less than 0.5), such as automobile engine hoods and covers. For those with a larger depth, due to the aluminum alloy's poor plasticity and low work hardening ability, it is easy to produce cracks in the transition fillet and suspended zones during deep drawing. Besides, the forming is difficult, and requires complicated processes such as multi-pass drawing and intermediate annealing. Even so, there are problems of low yield and poor quality of finished products. In order to improve the formability of the aluminum alloy, hot drawing is developed to form deep-cavity thin-walled curved parts, which have a depth-to-diameter ratio up to 1.2. However, the softening of the material under heating can easily lead to concentrated deformation in the suspended zone (force transmission zone), resulting in uneven deformation or even cracking. What's more, it is not easy to control the microstructure and properties during hot drawing, and it is necessary to improve the strength of the component through heat treatment (solution quenching+ aging) after being formed. However, quenching after forming will cause serious deformation of the deep-cavity part and difficulty in shaping. Meanwhile, there are a series of problems such as surface scratches and complicated heating.

This new type of aluminum alloy deep-cavity thin-walled curved parts has a large depth and the high-strength aluminum alloy material is difficult to deform, resulting in easy cracking during room temperature drawing, uneven deformation during hot drawing and destruction of microstructure and properties.

SUMMARY

In order to solve the above-mentioned problems in the prior art, an objective of the present invention is to provide a method for forming an aluminum alloy thin-walled curved part by ultra-low temperature gradient drawing. The present invention greatly improves the formability and strain hardening index of the aluminum alloy sheet blank, and improves the forming quality of the deep-cavity thin-walled curved part.

To achieve the above purpose, the present invention provides the following technical solutions. The present invention provides a method for forming an aluminum alloy thin-walled curved part by ultra-low temperature gradient drawing. The method includes forming a deep-cavity thin-walled curved part from an aluminum alloy sheet by controlling formability and flow stress based on an ultra-low temperature gradient, and specifically includes the following steps:

- step 1: placing the aluminum alloy sheet on a die, and closing a blank holder to hold the aluminum alloy sheet in a flange zone;
- step 2: filling a cavity of a die shoe with an ultra-low temperature medium to cool a die cavity zone of the aluminum alloy sheet to a set low temperature, and forming an ultra-low temperature gradient in which the temperature of the die cavity zone is lower than the temperature in the flange zone;
- step 3: applying a set blank holder force to the blank holder, and controlling a punch to move downwards to form a deep-cavity thin-walled curved part;
- step 4: controlling the punch to move upwards, opening the blank holder, and taking out the formed deep-cavity thin-walled curved part.

Preferably, before step 1 is implemented, a molding surface zone of the punch is pre-cooled to a set temperature.

Preferably, the punch is provided therein with a cavity for containing the ultra-low temperature medium; a circulation path is formed between the cavity and a cryogenic container of the ultra-low temperature medium through a cryogenic filler.

Preferably, before step 1 is implemented, the blank holder and the die are cooled to a cooling temperature of −180° C. to 25° C.; the blank holder and the die are provided with a circulation path for circulating the ultra-low temperature medium, and the blank holder and the die are cooled through the circulation path.

Preferably, in step 2, the ultra-low temperature medium is filled to both upper and lower sides of the aluminum alloy sheet to cause the die cavity zone to be cooled to the set temperature quickly and uniformly.

Preferably, in step 2, the set of low temperature is −160° C. to −270° C.

Preferably, the aluminum alloy sheet is a rolled sheet, with a heat treatment state of annealed, quenched or aged; a wall thickness of the aluminum alloy sheet is 0.1-2.0 mm.

Preferably, the aluminum alloy sheet is made of Al—Cu alloy, Al—Mg alloy, Al—Mg—Si alloy, Al—Zn—Mg—Cu alloy or Al—Li alloy.

Preferably, the ultra-low temperature medium is one or two of liquid argon, liquid nitrogen or liquid helium.

Compared with the prior art, the present invention achieves the following technical effects:

(1) The present invention cools an aluminum alloy sheet in a die cavity zone to an ultra-low temperature directly through an ultra-low temperature medium, and makes the aluminum alloy sheet deformed at the ultra-low temperature. The present invention significantly improves the formability of the sheet, and avoids the problems of easy cracking in the transition fillet and the suspended zone during the traditional deep drawing process of the aluminum alloy deep-cavity thin-walled curved part.

(2) Through an ultra-low temperature gradient, the present invention improves the deformation resistance and strain hardening index of the sheet in the die cavity zone, and ensures that a flange zone is easy for deformation to facilitate flow, and the suspended zone is not easy for concentrated deformation to facilitate force transmission. This helps coordinated deformation of each zone of the sheet, promoting uniform deformation, and alleviating wall thickness reduction.

(3) The present invention cools the aluminum alloy sheet according to the temperature gradient required for deformation, without cooling the die as a whole, thus greatly reducing the heat consumption of the die.

(4) The present invention suppresses the multi-slip and recovery/recrystallization of the material during the ultra-low temperature deformation of the aluminum alloy sheet, which solves the problem of microstructure and property impairment caused by hot drawing, and improves the microstructure and properties of the material.

BRIEF DESCRIPTION OF DRAWINGS

To describe the technical solutions in the embodiments of the present invention or in the prior art more clearly, the following briefly describes the accompanying drawings required for describing the embodiments. Apparently, the accompanying drawings in the following description show merely some embodiments of the present invention, and a person of ordinary skill in the art may still derive other drawings from these accompanying drawings without creative efforts.

Figure 1:
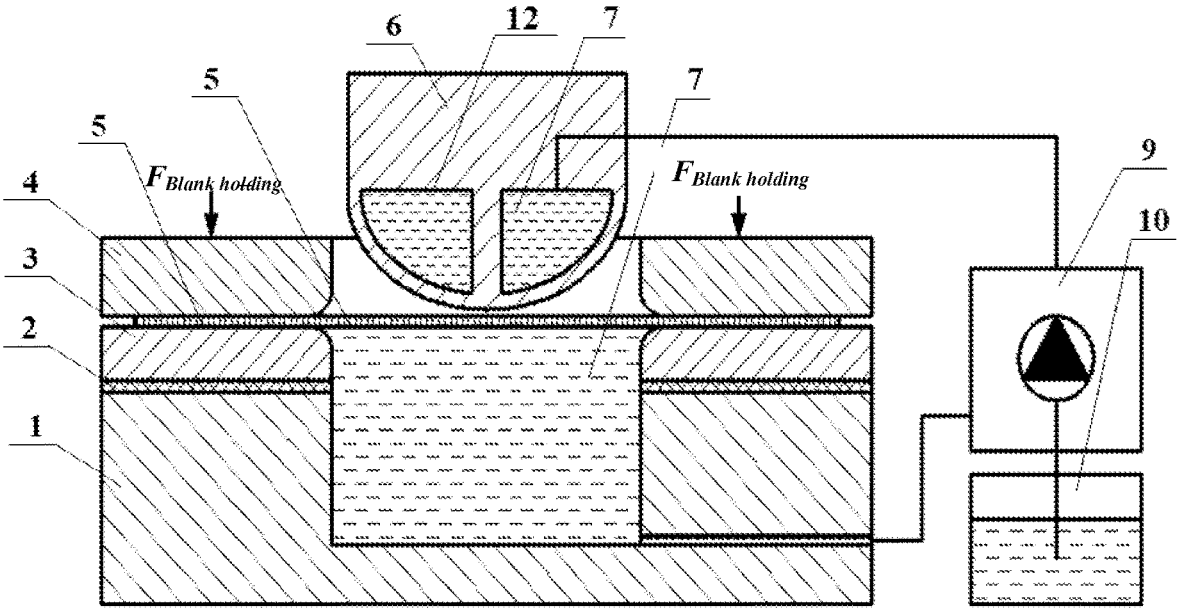
FIG. 1 is a first structural diagram of a method for forming an aluminum alloy thin-walled curved part by ultra-low temperature gradient drawing according to the present invention.
Figure 2:
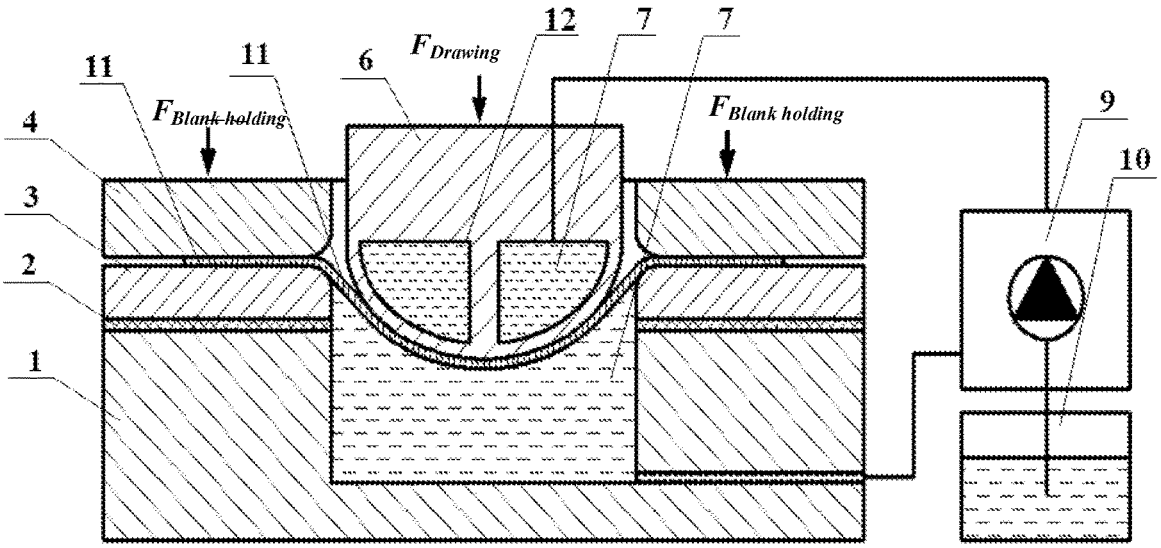
FIG. 2 is a second structural diagram of the method for forming an aluminum alloy thin-walled curved part by ultra-low temperature gradient drawing according to the present invention.
Figure 3:
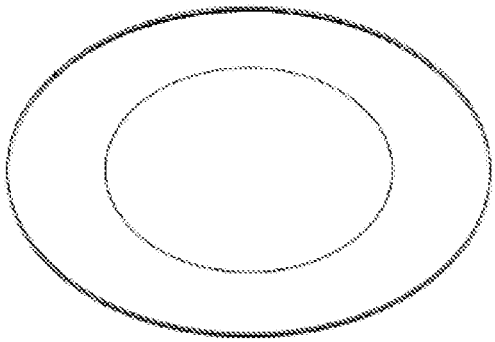
FIG. 3 is a diagram showing a blank of the method for forming an aluminum alloy thin-walled curved part by ultra-low temperature gradient drawing according to the present invention.

Reference Numerals: 1. die shoe; 2. heat insulation plate; 3. die; 4. blank holder; 5. aluminum alloy sheet; 6. punch; 7. ultra-low temperature medium; 8. circulation path; 9. cryogenic filler; 10. cryogenic container; 11. deep-cavity thin-walled curved part; and 12. cavity.

DETAILED DESCRIPTION

The following clearly and completely describes the technical solutions in the embodiments of the present invention with reference to accompanying drawings in the embodiments of the present invention. Apparently, the described embodiments are merely a part rather than all of the embodiments of the present invention. All other embodiments obtained by a person of ordinary skill in the art based on the embodiments of the present invention without creative efforts should fall within the protection scope of the present invention.

In order to solve the problems existing in the prior art, an objective of the present invention is to provide a method for forming an aluminum alloy thin-walled curved part by ultra-low temperature gradient drawing. The present invention greatly improves the formability and strain hardening index of the aluminum alloy sheet blank, and improves the forming quality of the deep-cavity thin-walled curved part.

To make the above objective, features and advantages of the present invention clearer and more comprehensible, the present invention is further described in detail below with reference to the accompanying drawings and specific embodiments.

Embodiment 1

As shown in FIGS. 1 to 7, this embodiment provides a method for forming an aluminum alloy thin-walled curved part by ultra-low temperature gradient drawing. The method forms a deep-cavity thin-walled curved part from an aluminum alloy sheet 5 by controlling the formability and flow stress based on an ultra-low temperature gradient. This method specifically includes the following steps:

Step 1: Place the aluminum alloy sheet 5 on a die 3, and close a blank holder 4 to hold the aluminum alloy sheet 5 in a flange zone. Before Step 1 is implemented, a molding surface zone of a punch 6 is pre-cooled to a set temperature. The punch 6 may also be provided therein with a cavity 12 for containing an ultra-low temperature medium 7. A circulation path is formed between the cavity 12 and a cryogenic container 10 of the ultra-low temperature medium 7 through a cryogenic filler 9. Before Step 1 is implemented, the blank holder 4 and the die 3 may also be cooled to a cooling temperature of −180° C. to 25° C. The blank holder 4 and the die 3 are provided with a circulation path 8 for circulating the ultra-low temperature medium 7, and the blank holder 4 and the die 3 are cooled through the circulation path 8. The pre-cooling of the naturally placed aluminum alloy sheet 5 on the die 3 will form a frozen lubricating layer on the surface of the aluminum alloy sheet 5, which will significantly reduce the flow resistance of the sheet in the flange zone and improve the uniformity of wall thickness.

Step 2: Fill a cavity of a die shoe 1 with the ultra-low temperature medium 7 to cool a die cavity zone of the aluminum alloy sheet 5 to a set low temperature of −160° C. to −270° C., and form an ultra-low temperature gradient in which the temperature of the die cavity zone is lower than the temperature in the flange zone. A heat insulation plate 2 is provided between the die 3 and the die shoe 1 to prevent temperature loss. The ultra-low temperature medium 7 may be filled to both upper and lower sides of the aluminum alloy sheet 5 to cause the die cavity zone to be cooled to the set temperature quickly and uniformly.

Step 3: Apply a set blank holder force to the blank holder 4, and control the punch 6 to move downwards to form a deep-cavity thin-walled curved part 11.

Step 4: Control the punch 6 to move upwards, open the blank holder 4, and take out the formed deep-cavity thin-walled curved part 11.

The aluminum alloy sheet 5 is a rolled sheet, with a heat treatment state of annealed, quenched or aged. A wall thickness of the aluminum alloy sheet 5 is 0.1-20 mm. The aluminum alloy sheet 5 is made of Al—Cu alloy, Al—Mg alloy, Al—Mg—Si alloy, Al—Zn—Mg—Cu alloy or Al—Li alloy. The ultra-low temperature medium 7 is liquid argon, liquid nitrogen or liquid helium.

Embodiment 2

As shown in FIGS. 1 to 4, this embodiment uses a solid-solution 2219 aluminum alloy sheet 5 with a thickness of 4 mm. A deep-cavity thin-walled curved part 11 has a diameter of 400 mm and a drawing depth of 400 mm. The bottom of the deep-cavity thin-walled curved part is an ellipsoidal surface with an axial length ratio of 1.6. The sheet in a die cavity zone is directly cooled by liquid nitrogen. The sheet in a flange zone is indirectly cooled by heat transfer of the sheet in the die cavity zone. A punch is cooled by liquid nitrogen, which can indirectly cool the sheet in the die cavity zone. This method specifically includes the following steps:

Step 1: Pour liquid nitrogen into a cavity of the punch 6, and cool a molding surface zone to below −180° C.

Step 2: Put the (room temperature) sheet 5 after decontamination treatment on the die 3, and close a blank holder 4 to hold the aluminum alloy sheet 5.

Step 3: Fill a lower side of the aluminum alloy sheet 5 with an ultra-low temperature medium 7 through a cryogenic filler 9 to cool the sheet in the die cavity zone to below −180° C., and form a gradient temperature field of the sheet with a lower temperature in the die cavity zone and a higher temperature in the flange zone, where the temperature gradient is greater than 160° C.

Step 4: Apply a set blank holder force to the blank holder 4, and enable the punch 6 to move downwards, so that the aluminum alloy sheet 5 is formed into a deep-cavity thin-walled curved part 11 according to the set blank holder force and a given drawing displacement.

Step 5: Recover the ultra-low temperature medium 7 into a cryogenic container 10, release the punch 6 and the blank holder 4, and take out the deep-cavity thin-walled curved part 11, thus completing the ultra-low temperature gradient drawing of the deep-cavity thin-walled curved part 11. Afterwards, the deep-cavity thin-walled curved part 11 is artificially aged.

In this embodiment, the bottom of the deep-cavity thin-walled curved part 11 may also be a flat surface, a spherical surface or a cone surface. In this embodiment, the liquid nitrogen may be replaced by liquid argon or liquid helium.

Embodiment 3

Figure 5:
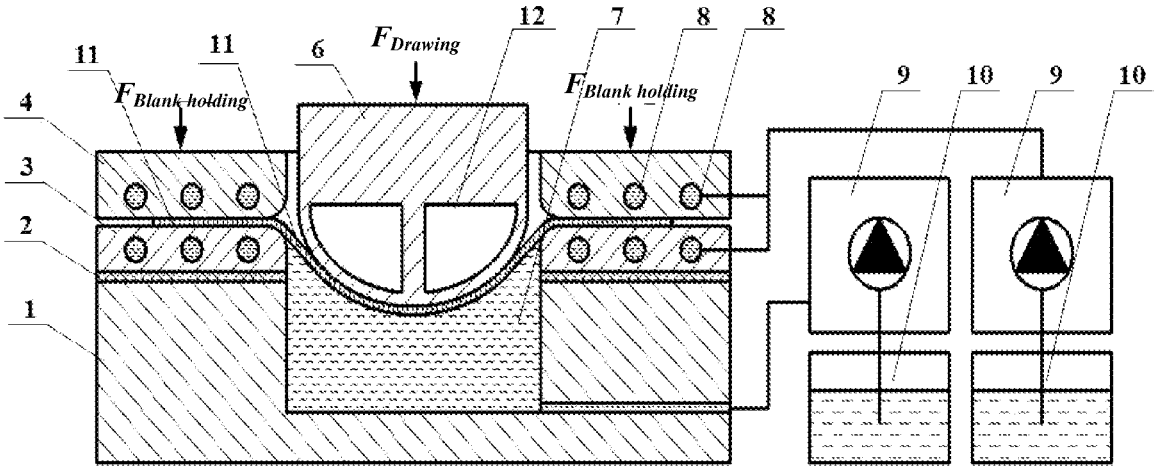
FIG. 5 is a structural diagram of Embodiment 3 of the present invention.

As shown in FIG. 5, this embodiment uses an annealed 5A06 aluminum alloy sheet 5 with a thickness of 6 mm. A deep-cavity thin-walled curved part 11 has a diameter of 600 mm and a drawing depth of 800 mm. The bottom of the deep-cavity thin-walled curved part is an ellipsoidal surface with an axial length ratio of 1.4. The sheet in a die cavity zone is directly cooled by liquid nitrogen. The sheet in a flange zone is indirectly cooled by pre-cooling a die with liquid argon. This method specifically includes the following steps:

Step 1: Use liquid argon as an ultra-low temperature medium 7 to simultaneously cool the die 3 and a blank holder 4 to below −120° C. The die 3 and the blank holder 4 are provided with a circulation path 8 for circulating the ultra-low temperature medium 7, and the die is cooled through the circulation path 8. The liquid argon/ultra-low temperature medium is filled into the die 3 and the blank holder 4 through a cryogenic filler.

Step 2: Put the (room temperature) sheet 5 after decontamination treatment on the die 3, and close the blank holder 4 to hold the aluminum alloy sheet 5 and cool the sheet in the flange zone to below −40° C.

Step 3: Fill a cavity below the sheet 5 with liquid nitrogen as an ultra-low temperature medium 7 through the cryogenic filler 9 to cool the aluminum alloy sheet in the die cavity zone to below −180° C., and form a gradient temperature field of the sheet with a lower temperature in the die cavity zone and a higher temperature in the flange zone, where the temperature gradient is greater than 60° C. The punch 6 may also be provided therein with a cavity 12 for containing the ultra-low temperature medium 7. A circulation path is formed between the cavity 12 and a cryogenic container 10 of the ultra-low temperature medium 7 through the cryogenic filler 9. In this way, the cooling of the sheet in the die cavity zone is accelerated, and the temperature of the sheet is reduced to a lower temperature. The molding surface zone of the punch may also be heat-insulated to prevent the temperature of the sheet from rising through the punch. In this embodiment, two ultra-low temperature media 7 of liquid argon and liquid nitrogen are used to meet different low temperature requirements.

Step 4: Apply a set blank holder force to the blank holder 4, and enable the punch 6 to move downwards, so that the aluminum alloy sheet 5 is formed into a deep-cavity thin-walled curved part 11 according to the set blank holder force and a given drawing displacement.

Figure 4:
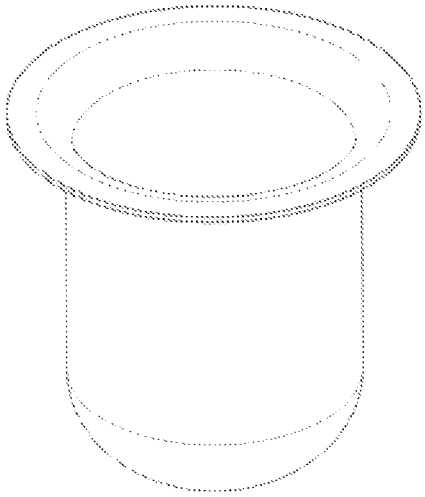
FIG. 4 is a diagram showing a deep-cavity thin-walled curved part formed according to Embodiment 2 of the present invention.

Step 5: Recover the ultra-low temperature medium 7 into the cryogenic container 10, release the punch 6 and the blank holder 4, open the die, and take out the deep-cavity thin-walled curved part 11, thus completing the ultra-low temperature gradient drawing of the deep-cavity thin-walled curved part 11. The formed deep-cavity thin-walled curved part 11 is also shown in FIG. 4.

In this embodiment, the bottom of the deep-cavity thin-walled curved part 11 may also be a flat surface, a spherical surface or a cone surface.

Embodiment 4

Figure 6:
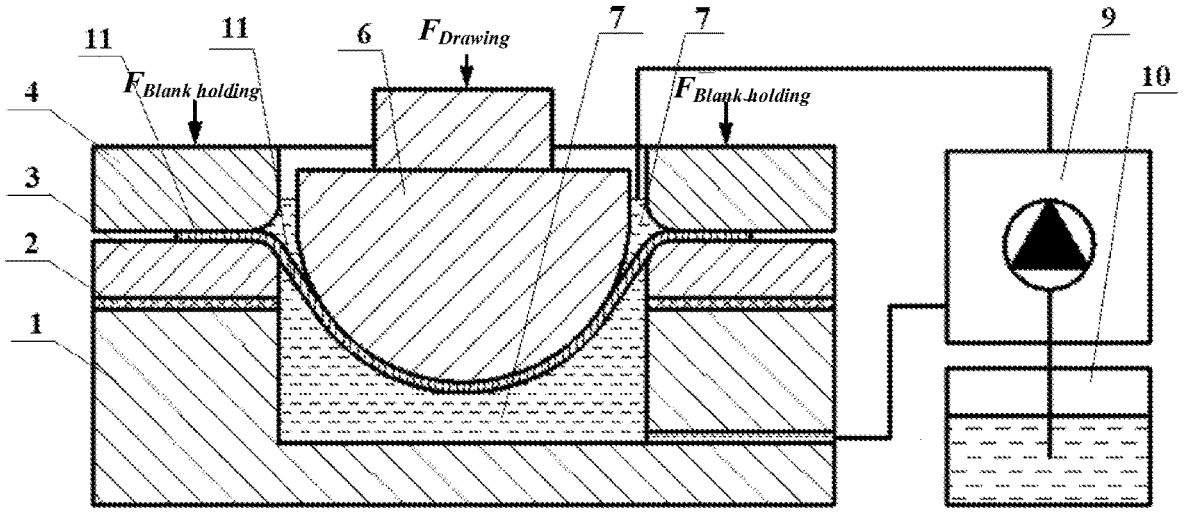
FIG. 6 is a structural diagram of Embodiment 4 of the present invention.
Figure 7:
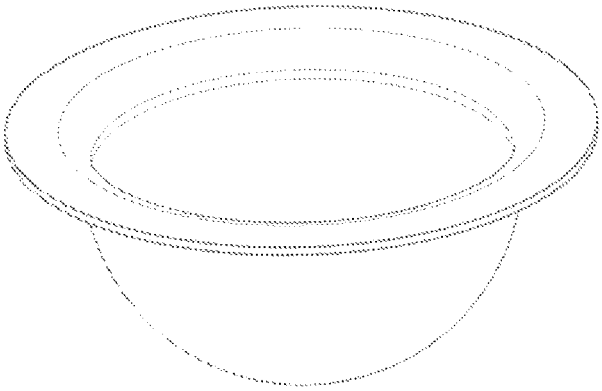
FIG. 7 is a diagram showing a deep-cavity thin-walled curved part formed according to Embodiment 4 of the present invention.

As shown in FIGS. 6 to 7, this embodiment uses a solid-solution 2195 Al—Li alloy sheet 5 with a thickness of 8 mm. A deep-cavity thin-walled curved part 11 has an ellipsoidal surface, and has an opening diameter of 2250 mm and an axial length ratio of 1.4. The sheet in a die cavity zone is directly cooled by liquid nitrogen fed through an upper cavity and a lower cavity, and the sheet in a flange zone is cooled indirectly through heat transfer of the sheet in the die cavity zone. A punch is heat-insulated to reduce the influence of the punch on the temperature of the sheet in the die cavity zone. This method specifically includes the following steps:

Step 1: Put the (room temperature) sheet 5 after decontamination treatment on a die 3, and close a blank holder 4 to hold the aluminum alloy sheet 5.

Step 2: Fill the cavities above and below the sheet with an ultra-low temperature medium 7 through a cryogenic filler 9 to cool the aluminum alloy sheet 5 in the die cavity zone to below −180° C., and form a gradient temperature field of the sheet with a lower temperature in the die cavity zone and a higher temperature in the flange zone, where the temperature gradient is greater than 150° C. The punch 6 may be heat-insulated to reduce the influence on the temperature of the sheet in the die cavity zone.

Step 3: Apply a set blank holder force to the blank holder 4, and enable the punch 6 to move downwards, so that the aluminum alloy sheet 5 is formed into a deep-cavity thin-walled curved part 11 according to the set blank holder force and a given drawing displacement.

Step 4: Recover the ultra-low temperature medium 7 into a cryogenic container 10, release the punch 6 and the blank holder 4, open the die, and take out the deep-cavity curved part 11, thus completing the ultra-low temperature gradient drawing of the deep-cavity thin-walled curved part 11. Afterwards, the deep-cavity curved part 11 is artificially aged.

In this embodiment, the deep-cavity thin-walled curved part has a large size, and the ellipsoidal surface of the deep-cavity thin-walled curved part 11 has an axial length ratio of 1.0 to 1.8. In this embodiment, the liquid nitrogen may be replaced by liquid argon or liquid helium.

The above embodiments cool the aluminum alloy sheet 5 in the die cavity zone to an ultra-low temperature through the ultra-low temperature medium 7, and make the aluminum alloy sheet 5 deformed at the ultra-low temperature. The present invention significantly improves the formability of the sheet, and avoids the problems of easy cracking in the suspended and fillet zones during the traditional deep drawing process of the aluminum alloy deep-cavity thin-walled curved part 11. The present invention forms a gradient temperature field with a higher temperature in the flange zone and a lower temperature in the die cavity zone. In this way, the present invention improves the deformation resistance and strain hardening index of the sheet in the die cavity zone, and ensures that the sheet in the flange zone is easy for deformation to facilitate flow, and the sheet in the die cavity zone is not easy for concentrated deformation to facilitate force transmission. This promotes uniform deformation and alleviates wall thickness reduction. The present invention cools the sheet according to the temperature gradient required for deformation, without cooling the die as a whole, thus greatly reducing the heat consumption of the die. The present invention suppresses the recovery/recrystallization of the material during the ultra-low temperature deformation, and solves the problem of microstructure and property impairment caused by hot forming. The present invention directly uses a solid-solution sheet to form the deep-cavity thin-wall curved part 11, and subsequent solution heat treatment is no longer required, thereby avoiding serious shape distortion caused by quenching.

Specific embodiments are used in the specification for illustration of the principles and implementations of the present invention. The description of the embodiments is used to help understand the method and its core principles of the present invention. In addition, those skilled in the art can make various modifications to specific implementations and application scope in accordance with the teachings of the present invention. In conclusion, the content of this specification should not be construed as a limitation to the present invention.

What is claimed is:

1. A method for forming an aluminum alloy curved part by temperature gradient drawing, comprising forming a deep-cavity curved part from an aluminum alloy sheet by controlling formability and flow stress based on a temperature gradient, and specifically comprising the following steps:

step 1: placing the aluminum alloy sheet on a die, and closing a blank holder to hold the aluminum alloy sheet in a flange zone;

step 2: filling a cavity of a die shoe with an ultra-low temperature medium to cool a die cavity zone of the aluminum alloy sheet to a set low temperature, and forming the temperature gradient in which the temperature of the die cavity zone is lower than the temperature in the flange zone, wherein the set low temperature is −160° C. to −270° C., wherein the ultra-low temperature medium is one or two of the liquid argon, liquid nitrogen or liquid helium;

step 3: applying a set blank holder force to the blank holder, and controlling a punch to move downwards to form a deep-cavity curved part; and step 4: controlling the punch to move upwards, opening the blank holder, and taking out the formed deep-cavity curved part;

wherein before step 1 is implemented, the blank holder and the die are cooled to a cooling temperature of −180° C. to −120° C.; the blank holder and the die are provided with a circulation path for circulating the ultra-low temperature medium, and the blank holder and the die are cooled through the circulation path.

2. The method for forming the aluminum alloy curved part by temperature gradient drawing according to claim 1, wherein the punch is provided therein with a cavity for containing the ultra-low temperature medium; and a circulation path is formed between the cavity and a cryogenic container of the ultra-low temperature medium through a cryogenic filler.

3. The method for forming the aluminum alloy curved part by temperature gradient drawing according to claim 1, wherein in step 2, the ultra-low temperature medium is filled to both upper and lower sides of the aluminum alloy sheet to cause the die cavity zone to be cooled to the set temperature uniformly.

4. The method for forming the aluminum alloy curved part by temperature gradient drawing according to claim 1, wherein the aluminum alloy sheet is a rolled sheet, with a heat treatment state of annealed, quenched or aged; and a wall thickness of the aluminum alloy sheet is 0.1-20 mm.

5. The method for forming the aluminum alloy curved part by temperature gradient drawing according to claim 1, wherein the aluminum alloy sheet is made of Al—Cu alloy, Al—Mg alloy, Al—Mg—Si alloy, Al—Zn—Mg—Cu alloy or Al—Li alloy.

* * * * *